US005979801A

United States Patent [19]

Munezane et al.

[11] Patent Number: 5,979,801

[45] Date of Patent: Nov. 9, 1999

[54] FUEL INJECTION VALVE WITH SWIRLER FOR IMPARTING SWIRLING MOTION TO FUEL

[75] Inventors: Tsuyoshi Munezane; Kensuke Imada; Keita Hosoyama; Norihisa Fukutomi; Masayuki Aota; Hirohisa Ohta; Mamoru Sumida, all of Tokyo, Japan

[73] Assignee: Mitsubishi Denki Kabushiki Kaisha, Tokyo, Japan

[21] Appl. No.: 08/917,422

[22] Filed: Aug. 26, 1997

[30] Foreign Application Priority Data

Jan. 30, 1997 [JP] Japan ..... 9-016366

[51] Int. Cl.[6] ..... F02M 61/00

[52] U.S. Cl. ..... 239/533.12; 239/463; 239/585.5; 239/DIG. 19

[58] Field of Search ..... 239/463, 494, 239/533.12, 585.1, 585.4, 585.5, DIG. 19, 477, 482, 472–273, 486, 491

[56] References Cited

U.S. PATENT DOCUMENTS

| | | | |
|---|---|---|---|
| 1,040,827 | 10/1912 | White | 239/482 |
| 2,549,092 | 4/1951 | Huber | 239/482 X |
| 4,452,578 | 6/1984 | Levine et al. | 239/463 |
| 5,108,037 | 4/1992 | Okamoto et al. | 239/533.12 X |
| 5,307,997 | 5/1994 | Wakeman | 239/491 |
| 5,427,319 | 6/1995 | Bata | 239/585.4 |
| 5,570,842 | 11/1996 | Kindley | 239/585.1 |
| 5,632,467 | 5/1997 | Just et al. | 239/585.4 X |

FOREIGN PATENT DOCUMENTS

| | | | |
|---|---|---|---|
| 484140 | 6/1952 | Canada | 239/494 |
| 36 43 523 A1 | 6/1988 | Germany . | |
| 64-36972 | 2/1989 | Japan | F02M 51/08 |
| 2-215963 | 8/1990 | Japan | F02M 51/08 |

OTHER PUBLICATIONS

Patent Abstracts of Japan, M–829 May 24, 1989, vol. 13/No. 223, JP 1–36972.

Patent Abstracts of Japan, M1373 Feb. 26, 1993, vol. 17/No. 99, JP 4–292573.

*Primary Examiner*—Steven J. Ganey

*Attorney, Agent, or Firm*—Sughrue, Mion, Zinn, Macpeak & Seas, PLLC

[57] ABSTRACT

A fuel injection valve includes: a valve seat provided at one end of a hollow valve main body and having an injection hole; a valve body separated/contacted from/with the valve seat to open/close the injection hole; and a swirler for surrounding the valve body to slidably support the valve body and for giving swirling to a fuel flowing into the injection hole, the swirler being produced by metal powder injection molding.

27 Claims, 7 Drawing Sheets

FUEL INJECTION VALVE WITH SWIRLER FOR IMPARTING SWIRLING MOTION TO FUEL

BACKGROUND OF THE INVENTION

1. Field of the Invention

This invention relates to a structure of a fuel injection valve for injecting fuel directly into a combustion chamber in an internal combustion engine.

2. Description of the Related Art

In a fuel injection valve of the type attached to a cylinder head of an internal combustion engine for injecting fuel directly into a combustion chamber, the fuel must be appropriately sprayed into the combustion chamber. As one means therefor, there was an apparatus in which a swirler gives swirling energy to a fuel flow to be injected so that fuel is injected from a fuel injection hole.

Japanese Patent Unexamined Publication No. Sho. 64-36972 discloses a conventional fuel injection valve. In FIG. 10A and 10B, a moving valve 101 is driven vertically by an electromagnetic drive means to be separated/contacted from/with a conical seat surface 105*b* of a valve guide 105 so that the valve is opened/closed to thereby inject fuel from a fuel injection hole 105*a*. On the other hand, a swirler 102 having a conical surface at the same angle as that of the seat surface 105*b* is disposed on the conical seat surface 105*b* of the valve guide 105. Two or more volute fuel grooves 102*b* are spirally formed in an outer circumferential portion of the swirler 102. The moving valve 101 is slidably disposed in a through-hole 102*a* along the center axis of the swirler 102. An elastic member 103 is interposed between the bottom surface of the conical surface of the swirler 102 and a stopper 104 integrally fixed to a yoke 107 so that the swirler 102 is urged toward the conical seat surface 105*b* by the elastic member 103.

In the apparatus depicted in FIGS. 10A and 10B, fuel introduced through a fuel passage of the yoke 107 passes through a stopper 104, a passage 103*b* of the elastic member 103 and is injected into a cylinder of an engine from the fuel injection hole 105*a* of the valve guide 105 through the fuel grooves 102*b* of the swirler 102. That is, a fuel flow is given swirling energy through the swirling grooves 102*b*, narrowed by the fuel injection hole 105*a* of the valve guide 105, atomized, and injected.

In the conventional fuel injection valve, the swirler for giving swirling energy to a fuel flow is generally machined and produced by cutting machining, or the like. In the case where such cutting is used, however, there arises a problem that the cost of production becomes high even if mass-production is carried out.

SUMMARY OF THE INVENTION

Accordingly, to solve the aforementioned problem, an object of the present invention is to provide a fuel injection valve in which not only a swirler for giving swirling force to fuel can be produced by mass production at low cost but also burrs which occurred in the conventional cutting are prevented from occurring, and further, it is possible that the swirler be formed to a complex shape.

In order to achieve the above problem, according to a first aspect of the present invention, provided is a fuel injection valve which comprises: a hollow valve main body; a valve seat provided at one end of the valve main body and having an injection hole; a valve body separated/contacted from/with the valve seat to open/close the injection hole; and a swirler for surrounding the valve body to slidably support the valve body and for giving swirling to fuel flowing into the injection hole, the swirler being produced by metal powder injection molding. Further, the swirler includes a first end surface abutted to the valve seat and provided with swirling grooves extending radially inward with respect to a valve axis.

BRIEF DESCRIPTION OF THE DRAWING FIGURES

BRIEF DESCRIPTION OF THE PREFERRED EMBODIMENTS

Embodiment 1

Figure 1:
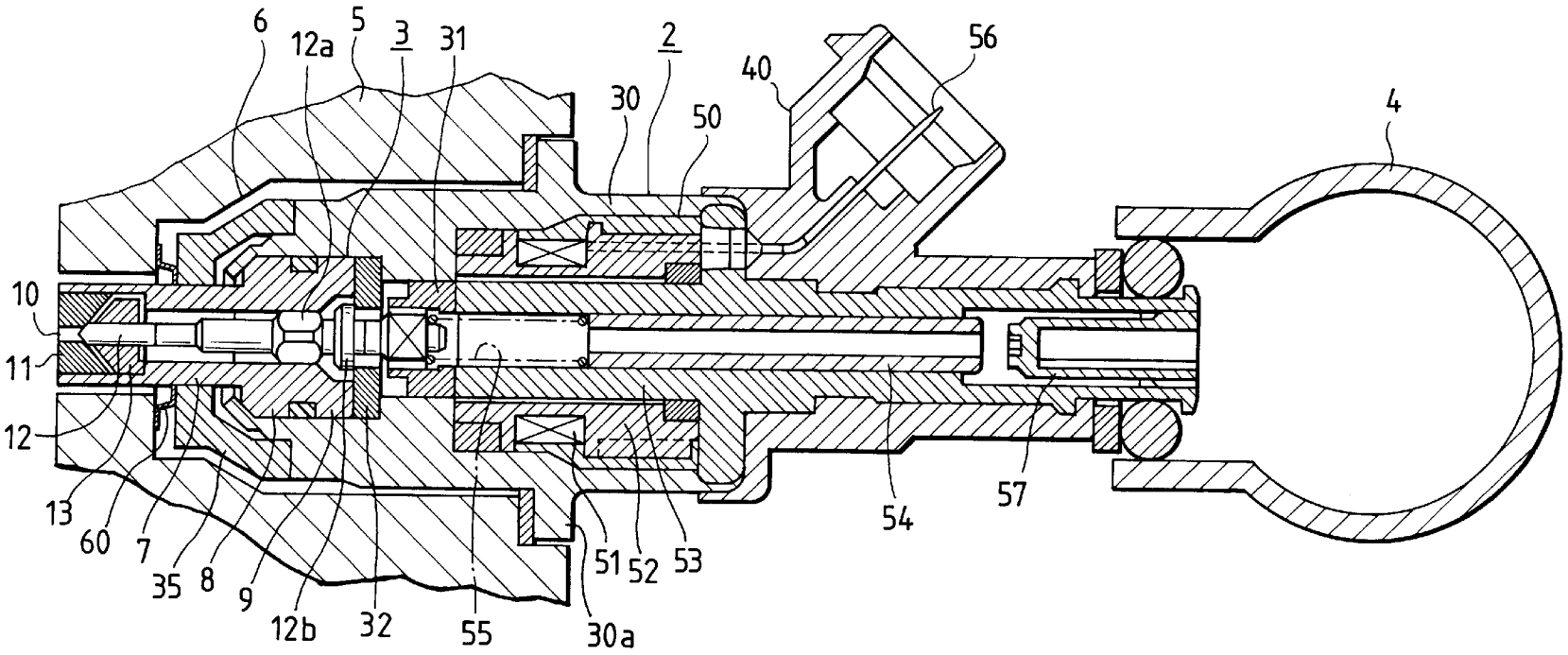
FIG. 1 is a side sectional view showing the overall configuration of an intra-cylinder-injection fuel injection valve according to an embodiment of the present invention.

In the FIG. 1, a fuel injection valve 1 for cylinder injection is constituted by a housing body 2 and a valve device 3 fixed on one end of the housing body 2 by caulking or any other means having a top end covered with a holder 35. The other end of the housing body 2 is connected to a fuel feed pipe 4, so that a high pressure fuel is fed from the fuel feed pipe 4 into the fuel injection valve 1 through a fuel filter 57. Further, a top end portion of the fuel injection valve 1 is inserted into an injection valve insertion hole 6 of a cylinder head 5 of an internal combustion engine so as to be attached therein while being sealed through a wave washer 60 or the like.

The valve device 3 is constituted by a valve main body 9 having a stepped hollow cylindrical shape, a valve seat 11, a needle valve 12, and a swirler 13. The valve main body 9 has small and large-diameter cylinder portions 7 and 8. The valve seat 11 is fixed to a top end of a center hole in the valve main body 9 and has a fuel injection hole 10. The needle valve 12 being a valve body, separates/contacts from/with the valve seat 11 by means of a solenoid device 50 (which will be described later) to thereby open/close the fuel injection hole 10. The swirler 13 axially guides the needle valve 12 and gives swirling motions to a fuel flowing radially inward into the fuel injection hole 10 of the valve seat 11.

The housing body 2 is provided with a first housing 30 having a flange 30*a* for attaching the fuel injection valve 1 on the cylinder head 5, and a second housing 40 having a solenoid device 50 mounted thereon. The solenoid device 50 has a bobbin 52 provided with a coil 51 wound thereon and a core 53 provided on an inner circumferential portion of the bobbin 52. The winding of the coil 51 is connected to a terminal 56. The core 53 is formed into a hollow cylindrical shape so that the inside thereof is used as a fuel passage. In a hollow portion of the core 53, a spring 55 is suspended between a sleeve 54 and the other end portion of the needle valve 12.

A movable armature 31 is attached on the other end portion of the needle valve 12 so as to face the top end of the core 53. Further, in an intermediate portion of the needle valve 12, there are provided a guide 12*a* for slidably guiding the needle valve 12 along an inner circumferential surface of the valve main body 9, and a needle flange 12*b* for contacting with a spacer 32 provided in the first housing 30.

Figure 2:
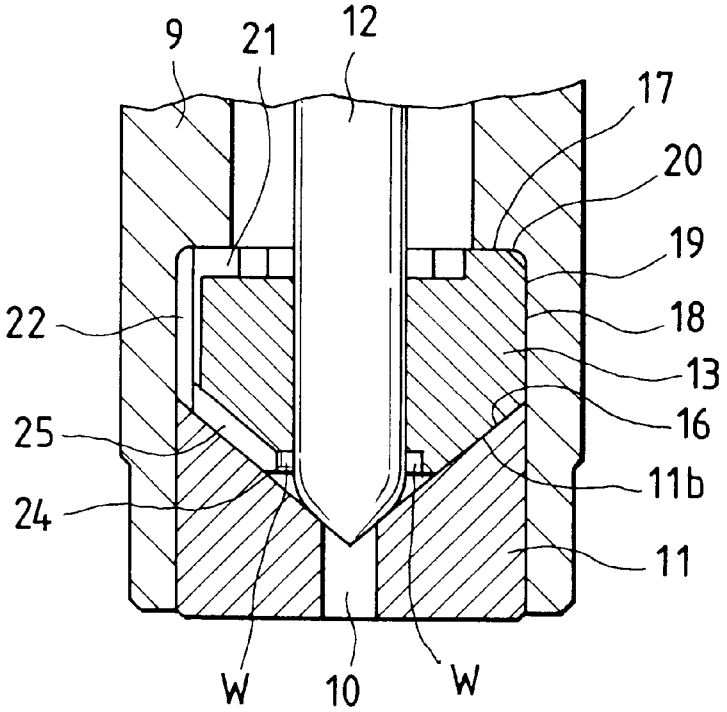
FIG. 2 is a side sectional view showing details of the neighborhood of the swirler and the valve seat in Embodiment 1.
Figure 3:
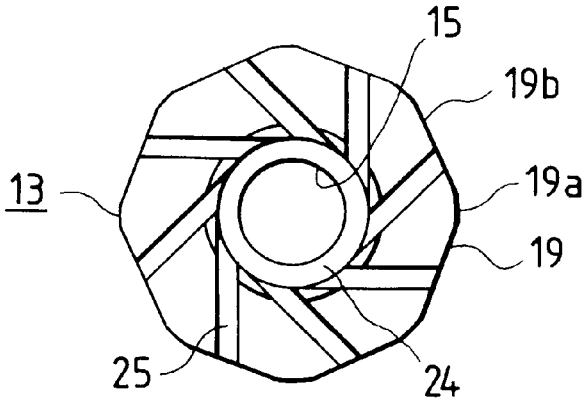
FIG. 3 is a front view from the valve seat side, of the swirler in Embodiment 1.

In the FIGS. 2 and 3, the swirler 13 is formed into a substantially-cylindrical hollow shape having a center hole 15 provided at its center so as to surround the needle valve 12, which is a valve body, to thereby axially slidably support the needle valve 12. The top end side (valve seat side) of the swirler 13 is formed into a substantially-conical hollow shape having an inclined surface (a first end surface) 16. That is, assembled in the valve device 3, the swirler 13 has the first end surface 16, a second end surface 17 and a circumferential surface 19. The first end surface 16 has substantially the same inclination angle as that of an inclined surface 11*b* of the valve seat 11 which is inclined relative to the valve axis by a predetermined angle, and the first end surface 16 is in contact with the inclined surface 11*b*. The second end surface 17 is provided so as to be in opposition to the valve seat 11. The circumferential surface 19 is formed between the end surfaces 16 and 17 and has a portion contacting with an inner circumferential surface 18 of the valve main body 9 which is a portion of the hollow housing.

The second end surface 17 of the swirler 13 is supported in the state where the circumferential portion thereof contacts with a shoulder portion 20 of the inner circumferential surface 18 of the valve main body 9. A radially extending passage groove 21 is formed in the second end surface 17 so that a fuel can flow from the inner circumferential portion of the second end surface 17 to the outer circumferential portion of the same.

A large number of axially-extending circumferentially equidistantly separated flat surfaces are formed on the circumferential surface 19 of the swirler 13. As a result, there are provided a plurality of outer circumferential surface portions 19*a* and flow path portions 19*b* on the circumferential surface 19. The outer circumferential surface portions 19*a* are in contact with the inner circumferential surface 18 of the valve main body 9 so as to define the position of the swirler 13 relative to the valve main body 9. The flow path portions 19*b* are flat surfaces provided respectively between the outer circumferential surface portions 19*a* so as to form fuel axial flow paths 22 together with the inner circumferential surface 18. The axial flow paths 22 are gaps between the inner circumferential surface 18 of the valve main body 9 and the flat flow path portions 19*b*, and the shape of each of the axial flow paths 22 is made to be substantially a one face convex lens in section.

The first end surface 16 contacts with the inclined surface 11*b* of the valve seat 11 and is inclined relative to the valve axis toward the injection hole 10 by a predetermined angle. On the first end surface 16, there are provided an inner circumferential annular groove 24 with a predetermined width formed in an inner circumference adjacent to the center hole 15 of the first end surface 16, and swirling grooves 25 which are connected at their one ends to the flow path portions 19*b* of the circumferential surface 19 and extend substantially radially inward from the connection portions so as to be tangentially connected at their other ends to the inner circumferential annular groove 24. A swirling chamber W for increasing and stabilizing the swirling force is constituted by the inner circumferential annular groove 24.

Figure 11:
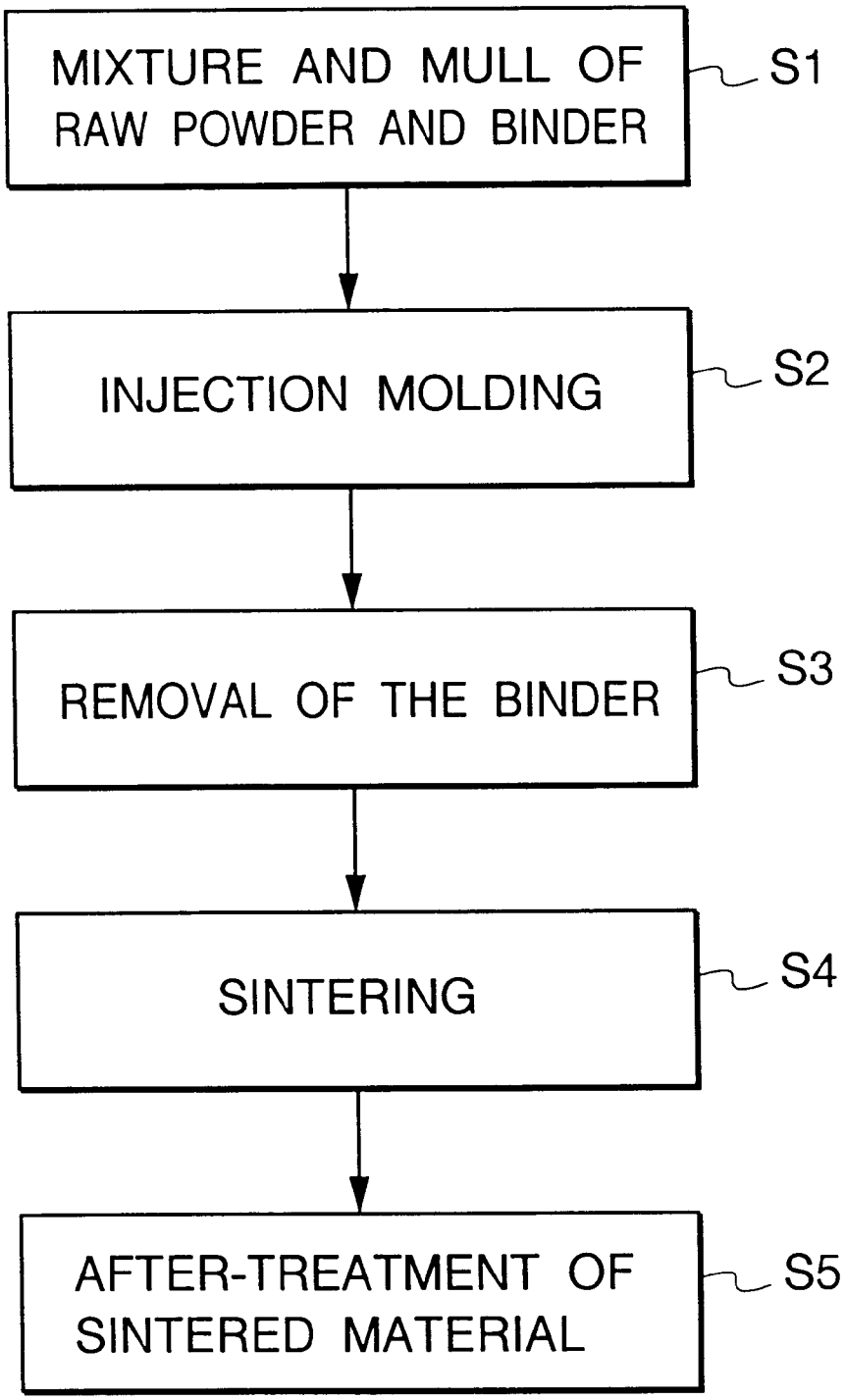
FIG. 11 is a flowchart showing an example of a metal powder injection molding of the present invention.

The above-mentioned swirler 13 is made from with a sintered material of metal powder injection molding. FIG. 11 shows an example of a manufacturing process of the metal powder injection molding. Mixed and mulled material of raw powder and binder is casted in a die and is injection molded. The molded material is heated to remove the binder and after that, is sintered.

Next, the operation of the fuel injection valve will be described. First, in FIG. 1, a current is externally supplied to the coil 51 of the solenoid device 50 through the terminal 56, so that magnetic flux is generated in the magnetic path constituted by the movable armature 31, the core 53, and the housing body 2, and the movable armature 31 is attracted toward the core 53 against the elastic force of the spring 55. Then, the needle valve 12 integrally provided with the movable armature 31 moves right in the drawing by a predetermined stroke till the needle flange 12*b* of the needle valve 12 contacts with the spacer 32. The needle valve 12 is guided and held on the inner circumferential surface of the valve main body 9 by means of the guide 12*a*.

Next, in FIGS. 2 and 3, the top end portion of the needle valve 12 is separated from the valve seat 11 to thereby form a gap, so that, first, a high pressure fuel fed from the fuel feed pipe 4 flows, from the path between the valve main body 9 and the needle valve 12, into the axial flow paths 22 of the circumferential surface through the path groove 21 of the second end surface 17 of the swirler 13. Then, the fuel flows into the swirling grooves 25 in the first end surface 16 of the swirler 13 inclined by a predetermined angle and flows radially inward through the swirling grooves 25. Then, the fuel flows tangentially into the inner circumferential annular groove 24 of the first end surface 16 so that a swirling flow is generated in the swirling chamber W constituted by the inner circumferential annular groove 24. Thereafter, the fuel flows into the injection hole 10 of the valve seat 11 and is sprayed out of the top end outlet of the injection hole 10.

As described above, in this Embodiment 1, the swirler 13 slidably supports the needle valve 12 which is a valve body. Being produced by metal powder injection molding, the swirler 13 can be made to have high density to thereby make it possible to increase the hardness. Therefore, there is such an effect that mass production can be performed at a low cost while securing the accuracy of size and the abrasion resistance which are equivalent to those at the time of cutting machining.

Further, since the swirler 13 is produced by metal powder injection molding, it is possible to obtain a shape which can be hardly formed by cutting machining, and it is possible to prevent generation of burrs which have been caused at the time of cutting machining.

Figure 10A:
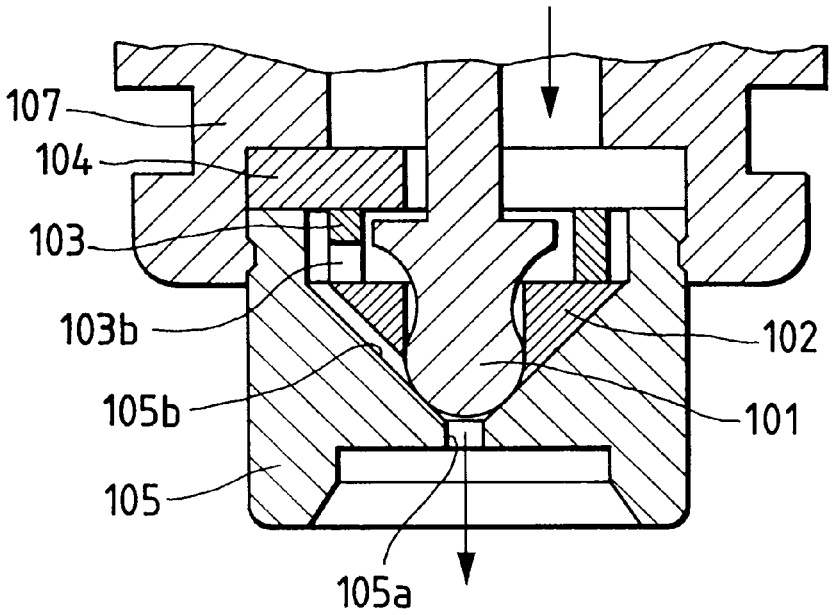
FIG. 10A PRIOR ART
FIGS. 10A and 10B are views showing the configuration of a conventional fuel injection valve and a swirler.
Figure 10B:
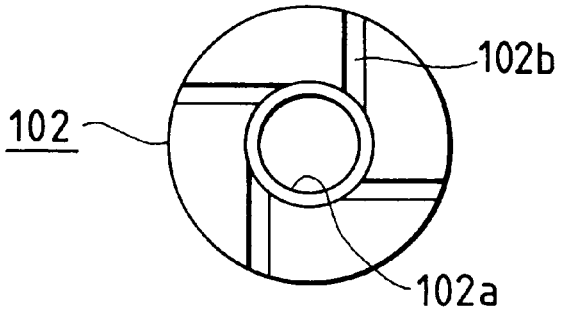
FIG. 10B PRIOR ART

Although the configurations of the fuel injection valve and swirler shown in FIGS. 1 through 3 have been illustrated by way of example in this Embodiment 1, if the swirler, for example, the swirler of FIG. 10 in the conventional example, for applying a swirling force to a fuel flow is produced with a sintered material of metal powder injection-molding, the same effects can be obtained. Further, although description has been made as to a fuel injection valve in which swirling grooves are formed in the swirler as a method of applying swirling to a fuel flow in the foregoing Embodiment 1, the present invention may be applied to a fuel injection valve of the type in which swirling is applied to a fuel flow by using any other method.

Embodiment 2

Figure 4:
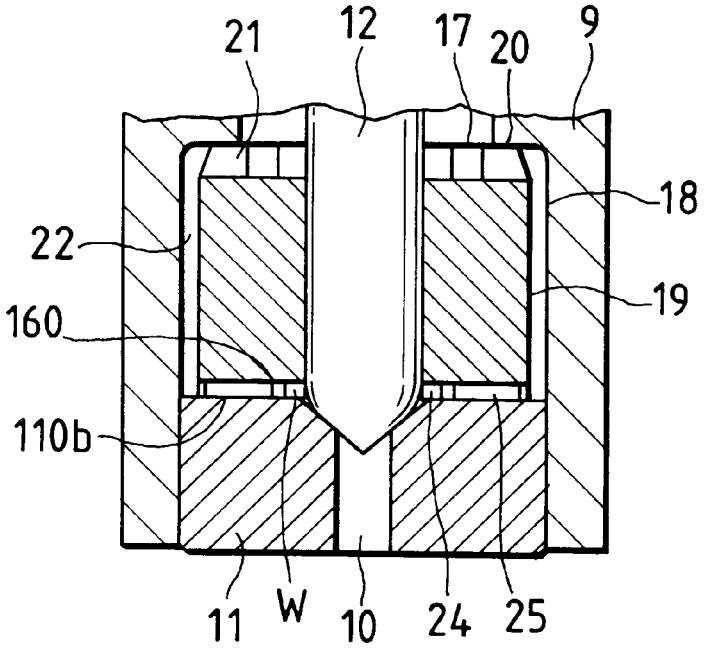
FIG. 4 is a side sectional view showing details of the neighborhood of the swirler and the valve seat in the fuel injection valve according to Embodiment 2.
Figure 5:
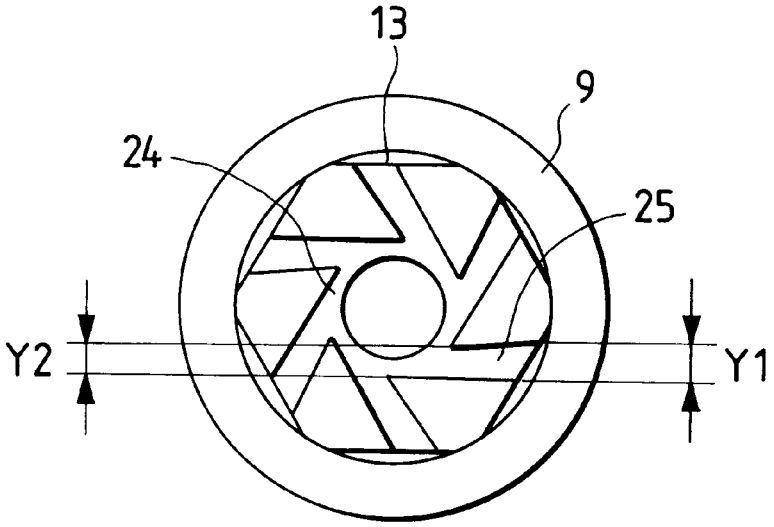
FIG. 5 is a front view, from the valve seat side, of the swirler in Embodiment 2.

In FIG. 4 and 5, the swirler 13 in this Embodiment 2 is formed into a substantially-cylindrical hollow shape for axially slidably supporting the needle valve 12. The swirler 13 has a first end surface 160 contacting with a flat surface 110*b* substantially perpendicular to the valve axis of the valve seat 11, the second end surface 17 provided in opposition to the valve seat 11, and the circumferential surface 19 provided between both the end surfaces so as to contact with the inner circumferential surface 18 of the valve main body 9. Further, the second end surface 17 of the swirler 13 contacts with a shoulder portion 20 of the valve main body 9 so as to be supported thereon and has an radially extending path groove 21 formed therein. Moreover, axial fuel flow paths 22 are formed between the circumferential surface 19 of the swirler 13 and the inner circumferential surface 18 of the valve main body 9.

In the first end surface 160 of the swirler 13 contacting with the flat surface 110*b* of the valve set 11, there are provided the inner circumferential annular groove 24 and swirling grooves 25 each of which has a groove inlet and a groove outlet, the width $Y_1$ of the groove inlet being wider than the width $Y_2$ of the groove outlet. Further, the inner circumferential annular groove 24 constitutes a swirling chamber W for increasing and stabilizing the swirling force of a fuel flow.

Further, it is preferable to produce the swirler 13 with a sintered material of metal powder injection molding because the swirler 13 has such a complicated shape as described above, particularly, a swirling groove shape.

In this Embodiment 2, a fuel flow flows into the axial flow paths 22 of the circumferential surface through the path groove 21 of the second end surface 17 of the swirler 13. Then, the fuel flow flows into the swirling grooves 25 formed in the first end surface 160 of the swirler 13 such that the width $Y_1$ of each groove inlet is wider than the width $Y_2$ of each groove outlet and flows radially inward through the swirling grooves 25. Then, the fuel flow flows tangentially into the inner circumferential annular groove 24 of the first end surface 160, so that a swirling flow is formed in a swirling chamber W constituted by the inner circumferential annular groove 24. Thereafter, the fuel flow flows into an injection hole 10 of the valve seat 11 and is sprayed out of a top end outlet thereof.

As described above, in this Embodiment 2, the width $Y_1$ of the groove inlet of each of the swirling grooves 25 of the swirler 13 is wider than the width $Y_2$ of the groove outlet of the same so that the swirling force of a fuel flow flowing through the swirling grooves 25 into the inner circumferential annular groove 24 is increased. Further, each of the swirling groove outlet portions of the swirler 13 is made to have the minimum flow path area. Accordingly, it is possible to restrict scattering of swirling to be applied to a fuel to make it possible to perform optimum control on spraying of a fuel by controlling only the sectional area of the flow path at each of the swirling groove outlet portions. Moreover, since the swirler 13 is produced by metal powder injection molding, it is possible to form a complicated shape of the swirler 13, for example, its grooves in this Embodiment 2 which was difficult by cutting machining and burrs which were generated at the time of cutting machining can be prevented from occurring.

Thus, this Embodiment 2 describes an example of the configuration in which the swirling grooves 25 of the swirler 13 are formed in the first end surface 160 substantially perpendicular to the valve axis as shown in FIGS. 4 and 5. However, the same effects can be obtained even when the foregoing feature of the groove width is applied to the swirler in which the swirling grooves 25 are formed in the first end surface 16 inclined to the valve axis by a predetermined angle as shown in FIGS. 2 and 3. Further, the feature of the groove width can be applied to any other general structure of a swirler having swirling grooves.

Embodiment 3

Figure 6:
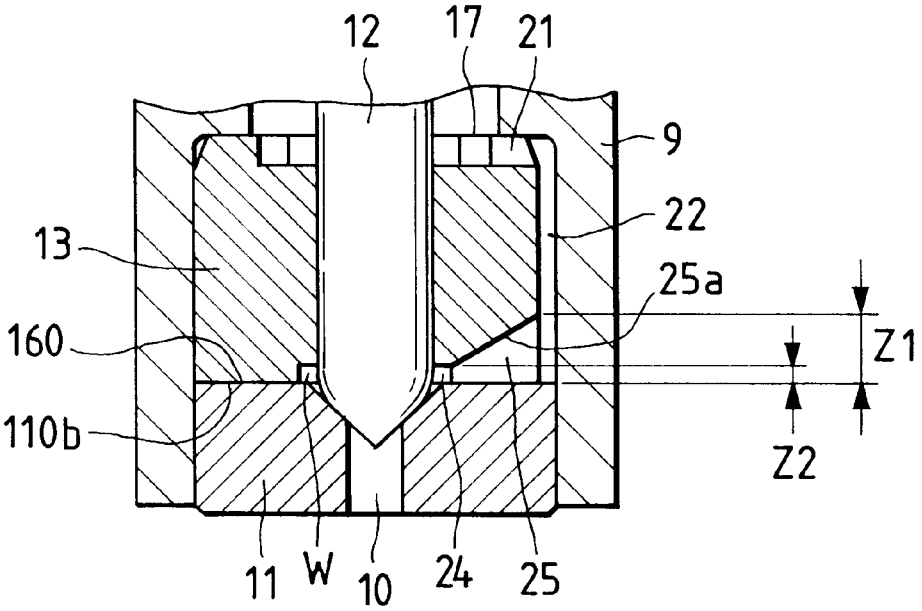
FIG. 6 is a side sectional view showing details of the neighborhood of the swirler and the valve seat in the fuel injection valve according to Embodiment 3.
Figure 7:
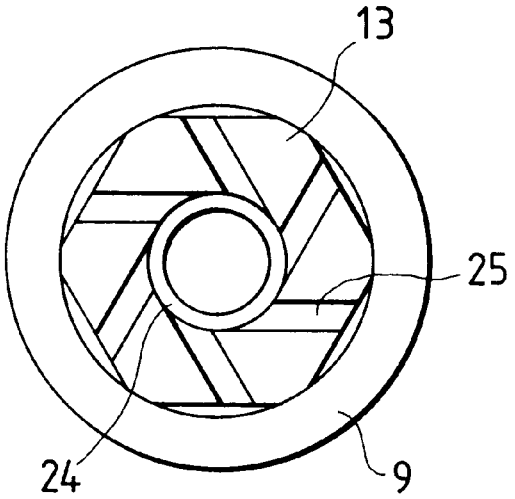
FIG. 7 is a front view, from the valve seat side, of the swirler in Embodiment 3.

In this Embodiment 3, as shown in FIGS. 6 and 7, there are provided the swirling grooves 25 and the inner circumferential annular groove 24 in the first end surface 160 of the swirler 13 contacting with the surface 110*b* of the valve seat 11. Each of the swirling grooves 25 are configured so that the height $Z_1$ of its groove inlet is larger than the height $Z_2$ of its groove outlet, and its groove bottom surface 25*a* is inclined relative to the valve seat 11 by the predetermined angle. The inner circumferential annular groove 24 forms the swirling chamber W for increasing and stabilizing the swirling force of a fuel flow. Further, the swirler 13 is produced with a sintered material of metal powder injection molding so as to form a complicated shape, particularly, a shape of swirling grooves.

In this Embodiment 3, a fuel flow flows into axial flow paths 22 in a circumferential surface through a path groove 21 of a second end surface 17 of the swirler 13. Next, the fuel flow flows into the swirling grooves 25 in each of which the height $Z_1$ of its groove inlet is larger than the height $Z_2$ of its groove outlet and its groove bottom surface 25*a* is inclined relative to the valve seat 11 by a predetermined angle, and then flows radially inward through the swirling grooves 25. Then, the fuel flow flows tangentially into the inner circumferential annular groove 24 of the first end surface 160 so that a swirling flow is formed in the swirling chamber W constituted by the inner circumferential annular groove 24. Thereafter, the fuel flow flows into the injection hole 10 of the valve seat 11 so as to be sprayed out of a top end outlet of the hole 10.

As described above, in this Embodiment 3, the bottom surface 25*a* of each swirling groove 25 of the swirler 13 for applying a swirling to a fuel is axially inclined so that an axial fluid force and a circumferential strong swirling force due to the reducing effect are applied to a fuel to thereby further increase and stabilize the fuel flow. Further, the swirling groove outlet portions of the swirler 13 are made to have the minimum flow path area, so as to control the sectional area of the flow path at each of the swirling groove outlet portions. Thus, it is possible to restrict scattering of swirling to be applied to a fuel to make it possible to perform optimum control on spraying of a fuel. Moreover, since the swirler 13 is produced by metal powder injection molding, it is possible to produce a complicated shape, for example, the shape of grooves in this Embodiment 3, which is difficult by cutting machining and burrs which are generated at the time of cutting machining can be prevented from occurring.

Embodiment 4

Figure 8:
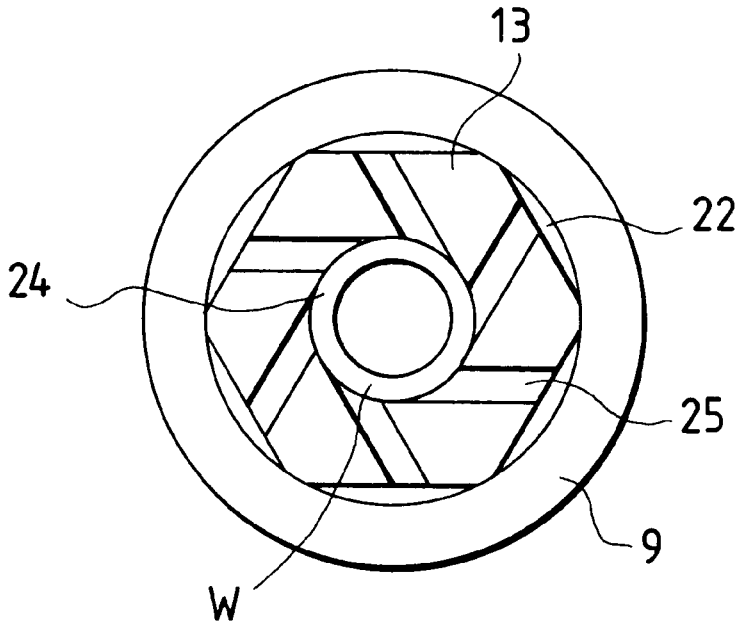
FIG. 8 is a view, from the injection hole side, of the swirler in the fuel injection valve according to Embodiment 4.
Figure 9:
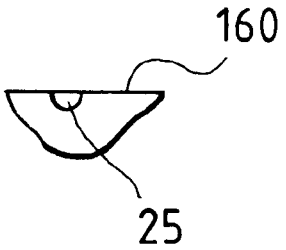
FIG. 9 is a view showing the sectional shape of each of the swirling grooves in the swirler according to Embodiment 4.

In this Embodiment 4, as shown in FIGS. 8 and 9, the swirling grooves 25 in each of which the shape in section is made to be a semicircle having a diameter equal to that of an end surface opening at the valve seat side or a part of a circle smaller than a semicircle are formed in the first end surface 160 of the swirler 13. Other portions of configuration are the same as those of the foregoing Embodiments.

In the swirler 13 according to this Embodiment 4, a fuel flow flows into axial flow paths 22 in a circumferential surface through a path groove 21 in a second end surface 17 of the swirler 13. Then, the fuel flow flows into the swirling grooves 25 in the first end surface 160 of the swirler 13. Each of the grooves 25 has a sectional shape which is made to be a semicircle or a part of a circle smaller than a semicircle. Then, the fuel flow flows radially inward in the swirling grooves 25 and flows tangentially into the inner circumferential annular groove 24 of the first end surface 160 so that a swirling flow is formed in the swirling chamber W constituted by the inner circumferential annular groove 24. Thereafter, the fuel flow flows into the injection hole 10 of the valve seat 11 so as to be sprayed out of the top end outlet of the injection hole 10.

In this Embodiment 4, the sectional shape of each of the swirling grooves 25 of the swirler 13 for applying a swirling to a fuel is made to be a semicircle or a part of a circle smaller than a semicircle so that the ratio of the surface area to the flow path area of the groove increases to thereby reduce the flow path resistance to thereby strengthen the swirling to be applied to the fuel. Further, since the swirler is produced by metal powder injection molding, mass production can be easily performed at a low cost in comparison with cutting machining.

Although the sectional shape of each of the swirling grooves is made to be a semicircle or a part of a circle smaller than a semicircle in the above-mentioned Embodiment 4, the sectional shape may be made to be a semi-ellipse or a part thereof or other curvilinear shapes.

Other Embodiment

Although it has been preferable to produce the swirler with a sintered material of metal powder injection molding in the foregoing Embodiments, particularly, finishing or grinding is carried out, if necessary, on the inner and outer diameters and both the end surfaces of the swirler, particularly in the case where the accuracy at the time of assembling is required.

According to the invention, the swirler is produced by metal powder injection molding to thereby make it possible to produce such a complex shape which has been hardly produced by cutting machining and to prevent occurrence of burrs which have been generated in the cutting machining.

The density of the swirler which serves to slidably support a needle valve as a valve body can be particularly heightened so that the hardness of the swirler can be heightened. As a result, fuel injection valves can be mass-produced at low cost while dimensional accuracy and abrasion resistance are kept equivalent to those in the cutting machining.

Further, according to the invention, the width Y1 of the groove inlets of the swirling grooves of the swirler is designed to be larger than the width Y2 of groove outlets thereof to thereby strengthen the swirling force of the fuel flow. Further, the minimum flow path area of the swirler is provided in the outlet portion of each of the swirling grooves. Accordingly, scattering of swirling given to fuel is suppressed by the management of only the flow path sectional area of the outlet portion of each of the swirling grooves so that fuel atomization control can be optimized.

Further, according to the invention, the bottom surface of each of the swirling grooves of the swirler for giving swirling to fuel is inclined relative to the direction of the axis. Accordingly, a fluid force in the axial direction and a strong swirling force in the direction of the circumference of the valve due to the narrowing effect are given to the fuel to thereby attain further strengthening and stabilizing the swirling force of the fuel flow. Further, the minimum flow path area of the swirler is provided in the outlet portion of each of the swirling grooves. Accordingly, scattering of swirling given to fuel is suppressed by management of only the flow path sectional area of the outlet portion of each of the swirling grooves so that fuel atomization control can be optimized.

In addition, according to the invention, each of the swirling grooves of the swirler is shaped like a semicircle or a part of a circle smaller than the semicircle. Accordingly, the rate of the surface area to the flow path area of each of the grooves becomes large, so that flow path resistance can be reduced and swirling given to the fuel can be strengthened.

What is claimed is:

1. A fuel injection valve comprising:

a hollow valve main body;

a valve seat provided at one end of said valve main body and having an injection hole;

a valve body slidably supported so as to be separated from and brought into contact with said valve seat to open and close said injection hole; and a swirler for surrounding said valve body to slidably support said valve body and for imparting a swirling motion to fuel flowing into said injection hole, said swirler being produced by metal powder injection molding and comprising:

swirling grooves extending radially inward with respect to a valve axis; and an inner circumferential annular groove connected to said swirling grooves at an inner periphery of said swirler, wherein one edge of each of said swirling grooves extends tangentially to an outer periphery of said inner circumferential annular groove.

2. A fuel injection valve according to claim 1, wherein said swirler includes a first end surface in contact with said valve seat.

3. A fuel injection valve according to claim 2, wherein a sectional shape of each swirling groove is a semicircle or a part of a circle smaller than a semicircle.

4. A fuel injection valve according to claim 1, wherein said swirler further comprises a first end surface contacted with said valve seat and a second end surface opposite to said first end surface, said first end surface including said swirling grooves.

5. A fuel injection valve according to claim 4, wherein said swirler further comprises a radially extending passage groove in said second end surface.

6. A fuel injection valve according to claim 4, wherein said swirler further comprises a peripheral surface extending between said first end surface and said second end surface, said peripheral surface including axial flow paths each having a flow path sectional area larger than a flow path sectional area of a respective swirling groove.

7. A fuel injection valve according to claim 4, wherein said swirling grooves are open to said first end surface along their lengths.

8. A fuel injection valve comprising:

a hollow valve main body;

a valve seat provided at one end of said valve main body having an injection hole;

a valve body slidably supported so as to be separated from and brought into contact with said valve seat to open and close said injection hole; and a swirler for surrounding said valve body to slidably support said valve body and for imparting a swirling motion to fuel flowing into said injection hole, said swirler including a first end surface in contact with said valve seat and a second end surface opposite to said first end surface, said first end surface being provided with swirling grooves extending radially inward with respect to a valve axis, each swirling groove having a groove inlet and a groove outlet, said groove inlet having a groove width larger than a groove width of said groove outlet, and said groove inlet having a flow path sectional area larger than a flow path sectional area of said groove outlet, said second end surface being provided with a radially extending passage groove, said swirler further including an inner circumferential annular groove connected to said swirling grooves at an inner periphery of said swirler.

9. A fuel injection valve according to claim 8, wherein said swirler is produced by metal powder injection molding.

10. A fuel injection valve according to claim 8, wherein each of said swirling grooves tapers between said respective groove inlet and said respective groove outlet.

11. A fuel injection valve according to claim 8, wherein one edge of each of said swirling grooves extends tangentially to an outer periphery of said inner circumferential annular groove.

12. A fuel injection valve according to claim 8, wherein said swirler further comprises a peripheral surface extending between said first end surface and said second end surface, said peripheral surface including axial flow paths each having a flow path sectional area larger than a flow path sectional area of a respective swirling groove.

13. A fuel injection valve according to claim 8, wherein said swirling grooves are open to said first end surface along their lengths.

14. A fuel injection valve according to claim 8, wherein a sectional shape of each swirling groove is a semicircle or a part of a circle smaller than a semicircle.

15. A fuel injection valve comprising:

a hollow valve main body;

a valve seat provided at one end of said valve main body and having an injection hole;

a valve body slidably supported so as to be separated from and brought into contact with said valve seat to open and close said injection hole; and a swirler for surrounding said valve body to slidably support said valve body and for imparting a swirling motion to fuel flowing through said valve, said swirler having a first end surface contacted with said valve seat and a second end surface opposite to said first end surface, said first end surface being provided with swirling grooves extending radially inward with respect to a valve axis, each swirling groove having an axially inclined groove bottom surface with respect to the valve seat, each swirling groove having a groove inlet and a groove outlet, said groove inlet having a flow path sectional area larger than a flow path sectional area of said groove outlet, said second end surface being provided with a radially extending passage groove.

16. A fuel injection valve according to claim 15, wherein said swirler is produced by metal powder injection molding.

17. A fuel injection valve according to claim 15, wherein said swirler further comprises an inner circumferential annular groove connected to said swirling grooves at an inner periphery of said swirler.

18. A fuel injection valve according to claim 17, wherein one edge of each of said swirling grooves extends tangentially to an outer periphery of said inner circumferential annular groove.

19. A fuel injection valve according to claim 15, wherein said swirler further comprises a peripheral surface extending between said first end surface and said second end surface, said peripheral surface including axial flow paths each having a flow path sectional area larger than a flow path sectional area of a respective swirling groove.

20. A fuel injection valve according to claim 15, wherein said swirling grooves are open to said first end surface along their lengths.

21. A fuel injection valve according to claim 15, wherein a sectional shape of each swirling groove is a semicircle or a part of a circle smaller than a semicircle.

22. A fuel injection valve comprising:

a hollow valve main body;

a valve seat provided at one end of said valve main body and having an injection hole;

a valve body slidably supported so as to be separated from and brought into contact with said valve seat to open and close said injection hole; and a swirler for surrounding said valve body to slidably support said valve body and for imparting a swirling motion to fuel flowing into said injection hole, said swirler comprising:

a first end surface contacted with said valve seat and a second end surface opposite to said first end surface, swirling grooves, provided on said first end surface and extending radially inward with respect to a valve axis;

an inner circumferential annular groove connected to said swirling grooves at an inner periphery of said swirler; and wherein said swirler is produced by metal powder injection molding.

23. A fuel injection valve according to claim 22, wherein one edge of each of said swirling grooves extends tangentially to an outer periphery of said inner circumferential annular groove.

24. A fuel injection valve according to claim 22, further including a radially extending passage groove in said second end surface of said swirler.

25. A fuel injection valve according to claim 22, wherein said swirler further comprises a peripheral surface extending between said first end surface and said second end surface, said peripheral surface including axial flow paths each having a flow path sectional area larger than a flow path sectional area of a respective swirling groove.

26. A fuel injection valve according to claim 22, wherein said swirling grooves are open to said first end surface along their lengths.

27. A fuel injection valve according to claim 22, wherein a sectional shape of each swirling groove is a semicircle or a part of a circle smaller than a semicircle.

* * * * *